United States Patent [19]

Doktor, deceased et al.

[11] 3,963,305

[45] June 15, 1976

[54] TERMINAL BLOCK CONSTRUCTION

[76] Inventors: Benjamin Doktor, deceased, late of Englewood, N.J.; by Henrietta Doktor, administratrix, 372 Thornton Road, Englewood, N.J. 07631

[22] Filed: Nov. 22, 1974

[21] Appl. No.: 526,269

[52] U.S. Cl. ..... 339/274; 24/134 R; 151/69

[51] Int. Cl.[2] ..... H01R 7/06

[58] Field of Search ..... 339/263, 274, 269–271; 24/132 R, 134 R, 249 R; 151/69; 285/178; 403/350, 374; 137/512.4, 512.15; 251/4, 9

[56] References Cited

UNITED STATES PATENTS

| | | | |
|---|---|---|---|
| 2,767,950 | 10/1956 | Bellon et al. | 151/69 |
| 3,042,896 | 7/1962 | Doktor | 339/274 |
| 3,215,394 | 11/1965 | Sherman | 24/134 R |
| 3,426,321 | 2/1969 | Peterson, Jr. | 151/69 |

*Primary Examiner*—Joseph H. McGlynn
*Attorney, Agent, or Firm*—Cooper, Dunham, Clark, Griffin & Moran

[57] ABSTRACT

An improvement on the terminal block construction of U.S. Pat. No. 3,042,896. A wedging member having a supporting shaft that extends through a hole in a support plate is provided with an enlarged portion at the end of the supporting shaft of slightly greater diameter than the diameter of the hole in the support plate. This permits the wedging member to be retained in place, but permits its removal and insertion by snap-out, snap-in action of the enlargement through the hole.

4 Claims, 5 Drawing Figures

TERMINAL BLOCK CONSTRUCTION

BACKGROUND AND BRIEF DESCRIPTION OF THE INVENTION

This invention is directed to an improvement in the terminal block construction of U.S. Pat. No. 3,042,896 which issued on 3 July 1962 to Benjamin Doktor, now deceased. An improved terminal connector is provided, as well as methods of fabricating and completing fabrication of a terminal connector.

The terminal block construction of U.S. Pat. No. 3,042,896 involves use of a housing element and a wedging member. The housing element and the wedging member have conductor contacting surfaces, and the wedging member is mounted for pivotal movement within the housing element in order to firmly engage an electrical conductor between the conductor contacting surfaces when the wedging member is in a predetermined pivotal position. A conductor is inserted into the housing element, and the wedging member is pivoted to the predetermined position in order to firmly engage the electrical conductor.

To this end, the wedging member includes a supporting shaft that extends through a hole in a support plate that forms a part of the housing element. The wedging member is pivotable about the supporting shaft. As disclosed in the patent, the supporting shaft is positioned within the hole. and then the end of the supporting shaft is enlarged by staking the same to retain the wedging member in place. The enlargement so produced prevents the wedging member from being removed from the housing element, and this has proven to be a disadvantage. In particular, it is not now possible to interchange wedging members so as to accomodate conductors of different sizes. The wedging member cannot be removed from its associated housing element without destruction of the enlarged supporting shaft end or the housing element or both. Further, the staking of the supporting shaft to enlarge its end has proven to be difficult in many instances, and the staking operation may damage the housing element or the wedging member or both.

The present invention is directed to providing a wedging member that may be easily inserted into and removed from an associated housing element without the need for staking. To this end, the supporting shaft is provided with an enlarged end portion of slightly greater diameter than the diameter of the hole in the support plate. The enlarged end portion extends outside the chamber of the housing element within which conductor contacting takes place. This enlarged portion may be snapped into and out of place, thereby releasably retaining the wedging member in position in the housing element. The wedging member can thus be easily changed, yet once in position it is retained in position by the enlarged end portion of the supporting shaft. Since the enlarged end portion extends outside the conductor contacting chamber, it does not interfere with the conductor contacting function.

The invention will be more completely understood by reference to the following detailed description, to be read in conjunction with the appended drawing.

DETAILED DESCRIPTION

Figure 1:
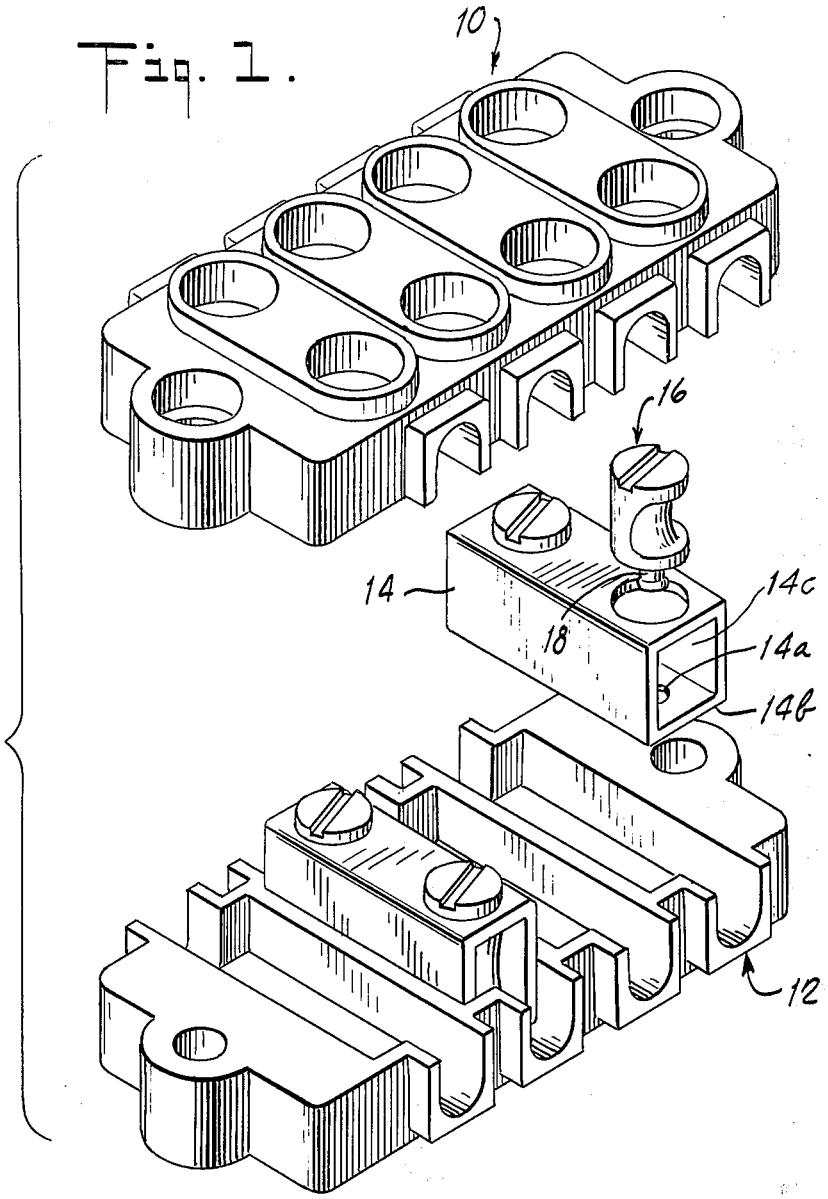
FIG. 1 is an exploded view in perspective showing an improved terminal block construction embodying the present invention.

Referring to FIG. 1, a terminal connector for an electrical conductor is shown involving an upper body element 10, a lower body element 12, a conductor engaging element or housing 14, and a wedging member 16. The upper and lower body elements 10 and 12 as well as the housing element 14 are virtually identical to the corresponding elements shown in FIG. 1 of U.S. Pat. No. 3,042,896. The entire disclosure of that patent is expressly incorporated herein by reference. That patent indicates the details of the upper and lower body elements 10 and 12, as well as the housing element 14. The wedging member 16 shown in FIG. 1 is virtually identical to the corresponding item shown in the patent, differing, however, significantly in the formation of supporting shaft 18.

Figure 5:
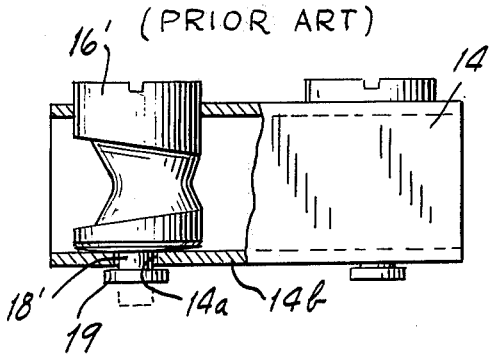
Fig. 5. (PRIOR ART)
FIG. 5 is similar to FIG. 4 showing the construction previously utilized and as disclosed in U.S. Pat. No. 3,042,896.

Reference to FIG. 5 will explain the differences in the supporting shaft construction. FIG. 5 shows a wedging member 16' as in the previously issued patent. Its supporting shaft 18' is initially rod shaped as shown by dashed line in FIG. 5. In practice, the wedging member 16' is inserted into the housing element 14 so that the supporting shaft 18' extends through **14*a* in support plate 14*b* forming a part of the housing element 14. After the wedging member 16' is inserted within the housing, the lower end of the shaft 18' is staked so as to produce a greatly enlarged head 19 as disclosed in the previously issued patent. Once the enlarged head 19 is formed, the wedging member 16' cannot be removed from the housing element 14 without breaking the enlarged head 19** or damaging the housing element or both. Further it has been found that errors in alignment of the parts during a staking operation have caused damage to the wedging member or the housing element or both.

Figure 2:
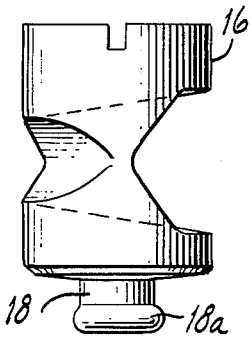
FIGS. 2 and 3 are alternative forms of wedging members embodying the invention.
Figure 4:
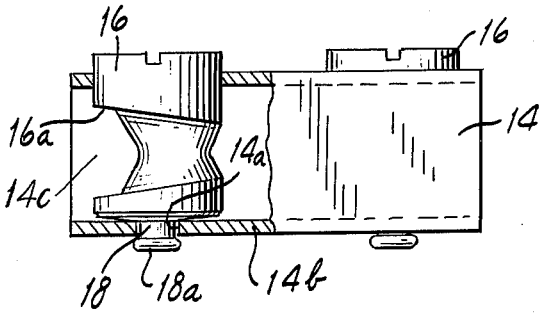
FIG. 4 is a partly sectional view showing the wedging member of FIG. 2 in position in a housing element.

Refer now to FIG. 2 which shows a wedging member 16 that is presently preferred and which embodies the present invention. The supporting shaft 18 is preformed with an enlarged end portion **18*a*. In this case the enlarged end portion comprises a round shoulder at the end of the supporting shaft. The largest diameter of that rounded shoulder is slightly greater than the diameter of the hole 14*a* in the support plate 14*b* of the housing element 14. In this fashion, the wedging member 16 may be inserted within the housing and the rounded shoulder 18*a* forced through the hole 14*a* in "snap-in" fashion. FIG. 4 shows the wedging member 16 in position in the housing element 14 (in this case two of such wedging members are shown). It will be noted that the enlarged end portion 18*a* is completely through the support plate 14*b*, and is on the opposite side of that support plate from the remainder of the wedging member 16. That is, the enlarged end portion 18*a* extends outside chamber 14*c* defined by the walls of the housing element so as not to interfere with the conductor contacting function which takes place within the chamber. The diameter of the supporting shaft 18 within the hole 14*a* in the support plate is slightly less than the diameter of the hole, permitting unrestrained pivotal movement of the wedging member 16 within the housing element 14. If it is desired to remove the wedging member 16, that wedging member may be removed by prying it upwardly, for example, by use of a screwdriver bearing against surface 16***a* shown in FIG. 4. In this fashion the wedging member 16 is "snapped-out" of place and the same wedging member or another wedging member can be easily reinserted by snapping it into place as described above.

Figure 3:
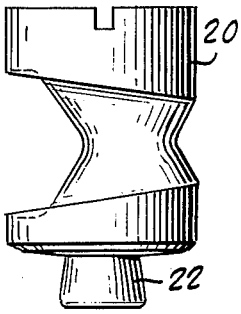

FIG. 3 shows an alternative construction. In this case wedging member 20 includes a supporting shaft 22 which is tapered to increasingly larger diameter toward the end thereof. The largest diameter of the supporting shaft is slightly larger than the diameter of the hole 14*a* in the support plate 14*b*. Like the wedging member of FIG. 2, the wedging member of FIG. 3 can be snapped into and out of place within the housing element 14.

Some representative dimensions may be of interest. With respect to the wedging member 16 shown in FIG. 2, the diameter of the supporting shaft 18 (the constant diameter portion) next to the enlarged shoulder 18*a* may be 0.085 to 0.090 inch. The largest diameter of the enlarged shoulder 18*a* may be 0.098 to 0.101 inch. The diameter of the hole 14*a* in the support plate 14*b* may be 0.002 to 0.003 inch less in diameter than the largest diameter of the enlarged shoulder 18*a* given above. In the case of the wedging member shown in FIG. 3, the smallest diameter of the supporting shaft 22 may be 0.094 inch, while the largest diameter (at the outer end) may be 0.101 inch, involving a 2° taper of the supporting shaft. The hole size of 14*a* would be the same as noted above. It should be realized, of course, that these dimensions are simply representative and used for illustrative purposes only.

The invention described above involving a uniquely improved terminal connector construction and methods of fabricating and completing fabrication of a terminal connector are susceptible of modification. Accordingly, the invention should be taken to be defined by the following claims.

What is claimed is:

1. A terminal connector for an electrical conductor comprising a housing element having walls thereof which define a chamber therein, a wedging member mounted for pivotal movement within said housing element, said housing element and said wedging member having conductor contacting surfaces within said chamber which firmly engage an electrical conductor therebetween in a predetermined pivotal position of said wedging member, said housing element including a support plate with a hole therein, said wedging member including a supporting shaft extending away from the conductor contacting surface of said wedging member and through said hole in said support plate to provide for said pivotal movement of said wedging member, said supporting shaft including an enlarged portion at an end thereof remote from said conductor contacting surface and extending outside said chamber and of slightly greater diameter than the diameter of said hole in said support plate sufficient to retain said wedging member in place but permitting removal and insertion of said wedging member from and into said housing element by snap-out, snap-in action in a direction along the axis of said supporting shaft, said enlarged end portion not interfering with the conductor contacting function of the wedging member by virtue of its location outside said chamber.

2. A terminal connector according to claim 1 in which said supporting shaft is tapered to an increasingly larger diameter toward the end thereof.

3. A terminal connector according to claim 1 in which said enlarged portion comprises a rounded shoulder at the end of said supporting shaft.

4. A terminal connector according to claim 3 in which said supporting shaft extends entirely through said supporting plate with said rounded shoulder on one side thereof, the diameter of the portion of said supporting shaft within the hole in said support plate being slightly less than the diameter of said hole.

* * * * *